US010679552B2

(12) United States Patent
Qian

(10) Patent No.: US 10,679,552 B2
(45) Date of Patent: Jun. 9, 2020

(54) PIXEL CIRCUIT AND DRIVE METHOD THEREOF, AND DISPLAY PANEL AND DISPLAY DEVICE

(71) Applicants: HEFEI XINSHENG OPTOELECTRONICS TECHNOLOGY CO., LTD., Anhui (CN); BOE TECHNOLOGY GROUP CO., LTD., Beijing (CN)

(72) Inventor: Xianrui Qian, Beijing (CN)

(73) Assignees: HEFEI XINSHENG OPTOELECTRONICS TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/343,718

(22) PCT Filed: Mar. 8, 2018

(86) PCT No.: PCT/CN2018/078369
§ 371 (c)(1),
(2) Date: Apr. 19, 2019

(87) PCT Pub. No.: WO2018/161926
PCT Pub. Date: Sep. 13, 2018

(65) Prior Publication Data

US 2019/0272785 A1 Sep. 5, 2019

(30) Foreign Application Priority Data

Mar. 8, 2017 (CN) ..... 2017 1 0136169

(51) Int. Cl.
*G09G 5/00* (2006.01)
*G09G 3/3225* (2016.01)
(Continued)

(52) U.S. Cl.
CPC ..... *G09G 3/3225* (2013.01); *G09G 3/3208* (2013.01); *G09G 3/3266* (2013.01); *G09G 2320/0626* (2013.01)

(58) Field of Classification Search
CPC .. G09G 3/3225; G09G 3/3208; G09G 3/3266; G09G 2320/0626; G09G 3/3233;
(Continued)

(56) References Cited

U.S. PATENT DOCUMENTS

2004/0108518 A1* 6/2004 Jo ..... G09G 3/006 257/200
2004/0189559 A1 9/2004 Shih
(Continued)

FOREIGN PATENT DOCUMENTS

CN 101030353 A 9/2007
CN 100437711 C 11/2008
(Continued)

OTHER PUBLICATIONS

International Search Report and Written Opinion issued in corresponding International Application No. PCT/CN2018/078369, dated May 21, 2018, with English translation.
(Continued)

*Primary Examiner* — Adam R. Giesy
(74) *Attorney, Agent, or Firm* — McDermott Will & Emery LLP

(57) ABSTRACT

A pixel circuit includes a first control sub-circuit, a second control sub-circuit, a current detection sub-circuit, a driving sub-circuit, and an energy storage sub-circuit. The first control sub-circuit is configured to transmit a voltage on a data voltage terminal to a first node under control of a voltage on a first scan signal terminal. The second control sub-circuit is configured to transmit the voltage on the first node to a control terminal of the driving sub-circuit under
(Continued)

control of a voltage on a second scan signal terminal. The current detection sub-circuit is configured to output a detection current under control of the voltage on the first node and detect a current value of the detection current. The driving sub-circuit is configured to output a driving current under control of the voltage on the control terminal of the driving sub-circuit. The energy storage sub-circuit is configured to store electrical energy.

14 Claims, 3 Drawing Sheets

(51) Int. Cl.
*G09G 3/3266* (2016.01)
*G09G 3/3208* (2016.01)

(58) Field of Classification Search
CPC ..... G09G 2310/08; G09G 2320/0233; G09G 2310/0262; G09G 2320/045; G09G 2300/0842; G09G 2300/0819
See application file for complete search history.

(56) References Cited

U.S. PATENT DOCUMENTS

| | | | |
|---|---|---|---|
| 2007/0159416 | A1 | 7/2007 | Whight |
| 2007/0200804 | A1 | 8/2007 | Kwon |
| 2010/0123649 | A1 | 5/2010 | Hamer et al. |
| 2015/0187271 | A1 | 7/2015 | Bae et al. |
| 2016/0300528 | A1 | 10/2016 | Kong et al. |
| 2016/0307500 | A1 | 10/2016 | Han |
| 2016/0358550 | A1 | 12/2016 | Qing et al. |
| 2017/0039941 | A1 | 2/2017 | Wu et al. |
| 2017/0162125 | A1 | 6/2017 | Liang |
| 2017/0169767 | A1 | 6/2017 | Song |
| 2019/0272785 | A1 | 9/2019 | Qian |

FOREIGN PATENT DOCUMENTS

| | | | |
|---|---|---|---|
| CN | 102257555 | A | 11/2011 |
| CN | 104332138 | A | 2/2015 |
| CN | 104517572 | A | 4/2015 |
| CN | 104575387 | A | 4/2015 |
| CN | 104680982 | A | 6/2015 |
| CN | 104751778 | A | 7/2015 |
| CN | 104809986 | A | 7/2015 |
| CN | 105047137 | A | 11/2015 |
| CN | 105702206 | A | 6/2016 |
| CN | 106782312 | A | 5/2017 |
| EP | 0905673 | A1 | 3/1999 |

OTHER PUBLICATIONS

First Office Action issued in corresponding Chinese Application No. 201710136169.3, dated Aug. 2, 2018, with English translation.

* cited by examiner

PIXEL CIRCUIT AND DRIVE METHOD THEREOF, AND DISPLAY PANEL AND DISPLAY DEVICE

CROSS-REFERENCE TO RELATED APPLICATION

This application is a national phase entry under 35 USC 371 of International Patent Application No. PCT/CN2018/078369 filed on Mar. 8 2018, which claims priority to Chinese Patent Application No. 201710136169.3, filed with the Chinese Patent Office on Mar. 8, 2017, titled "PIXEL CIRCUIT AND DRIVING METHOD THEREOF, AND DISPLAY DEVICE", which are incorporated herein by reference in their entirety.

TECHNICAL FIELD

The present disclosure relates to the field of display technologies, and in particular, to a pixel circuit and a driving method thereof, a display panel and a display device.

BACKGROUND

An organic light-emitting diode (OLED) display has advantages of a low power consumption, a low production cost, self-emission, a wide viewing angle and a high response speed as a new-generation display. At present, the OLED display has gradually superseded traditional liquid crystal display screens in mobile phones, personal digital assistants (PDAs), digital cameras and other display fields.

SUMMARY

In a first aspect, a pixel circuit is provided. The pixel circuit includes a first control sub-circuit, a second control sub-circuit, a current detection sub-circuit, a driving sub-circuit and an energy storage sub-circuit.

The first control sub-circuit is coupled to a data voltage terminal, a first scanning signal terminal and a first node, and the first control sub-circuit is configured to transmit a voltage on the data voltage terminal to the first node under control of a voltage on the first scanning signal terminal.

The second control sub-circuit is coupled to a control terminal of the driving sub-circuit, a second scanning signal terminal and the first node, and the second control sub-circuit is configured to transmit a voltage on the first node to the control terminal of the driving sub-circuit under control of a voltage on the second scanning signal terminal.

The current detection sub-circuit is coupled to a first level terminal, a second level terminal and the first node, and the current detection sub-circuit is configured to output a detection current under control of a voltage on the first node and detect a current value of the detection current.

An input terminal of the driving sub-circuit is coupled to a third level terminal, an output terminal of the driving sub-circuit is coupled to the second level terminal, and the driving sub-circuit is configured to output a driving current under control of a voltage on the control terminal of the driving sub-circuit.

The energy storage sub-circuit is coupled to the first node and the second level terminal, and the energy storage sub-circuit is configured to store electric energy.

Optionally, the pixel circuit further includes a display sub-circuit. An input terminal of the display sub-circuit is coupled to the third level terminal, an output terminal of the display sub-circuit is coupled to the input terminal of the driving sub-circuit, and the display sub-circuit is configured to display a gray scale under driving of the driving current.

Optionally, the first control sub-circuit includes a first transistor. A first electrode of the first transistor is coupled to the data voltage terminal, a second electrode of the first transistor is coupled to the first node, and a gate of the first transistor is coupled to the first scanning signal terminal.

Optionally, the second control sub-circuit includes a second transistor. A first electrode of the second transistor is coupled to the first node, a second electrode of the second transistor is coupled to the control terminal of the driving sub-circuit, and a gate of the second transistor is coupled to the second scanning signal terminal.

Optionally, the current detection sub-circuit includes a current detection device and a third transistor. An input terminal of the current detection device is coupled to the first level terminal, and an output terminal of the current detection device is coupled to a first electrode of the third transistor. A second electrode of the third transistor is coupled to the second level terminal, and a gate of the third transistor is coupled to the first node.

Optionally, the driving sub-circuit is a driving transistor. The input terminal of the driving sub-circuit is a source of the driving transistor, the control terminal of the driving sub-circuit is a gate of the driving transistor, and the output terminal of the driving sub-circuit is a drain of the driving transistor.

Optionally, the display sub-circuit includes an organic light-emitting diode. An anode of the organic light-emitting diode is coupled to the third level terminal, and a cathode of the organic light-emitting diode is coupled to the input terminal of the driving sub-circuit.

Optionally, the energy storage sub-circuit includes a first capacitor. A first electrode of the first capacitor is coupled to the first node, and a second electrode of the first capacitor is coupled to the second level terminal.

Optionally, the first transistor and the second transistor are both N-type transistors; or the first transistor and the second transistor are both P-type transistors.

Optionally, the first control sub-circuit includes a first transistor, the second control sub-circuit includes a second transistor, the driving sub-circuit is a driving transistor, the display sub-circuit includes an organic light-emitting diode, the current detection sub-circuit includes a current detection device and a third transistor, and the energy storage sub-circuit includes a first capacitor. A first electrode of the first transistor is coupled to the data voltage terminal, a second electrode of the first transistor is coupled to the first node, and a gate of the first transistor is coupled to the first scanning signal terminal. A first electrode of the second transistor is coupled to the first node, a gate of the second transistor is coupled to the second scanning signal terminal, a second electrode of the second transistor is coupled to a gate of the driving transistor, a drain of the driving transistor is coupled to the second level terminal, a source of the driving transistor is coupled to a cathode of the organic light-emitting diode, and an anode of the organic light-emitting diode is coupled to the third level terminal. A gate of the third transistor is coupled to the first node, a first electrode of the third transistor is coupled to an output terminal of the current detection device, a second electrode of the third transistor is coupled to the second level terminal, and an input terminal of the current detection device is coupled to the first level terminal. A first electrode of the first capacitor is coupled to the first node, and a second electrode of the first capacitor is coupled to the second level terminal.

In a second aspect, a method of driving the pixel circuit according to the first aspect described above is provided. The method includes:

in a first period, transmitting, by the first control sub-circuit, the voltage on the data voltage terminal to the first node under the control of a voltage on the first scanning signal terminal; outputting, by the current detection sub-circuit, the detection current and detecting, by the current detection sub-circuit, the current value of the detection current under the control of a voltage on the first node; adjusting the voltage on the data voltage terminal, and obtaining a first voltage on the first node in response to the detection current being equal to an initial current; obtaining a compensation voltage according to the first voltage; wherein the compensation voltage is a voltage difference between the first voltage and an initial voltage; and a current value of the initial current is a current value of the detection current in an initial state and when the voltage on the first node is the initial voltage;

in a second period, inputting, via the data voltage terminal, a second voltage according to a display driving voltage and the compensation voltage; the second voltage being a sum of the display driving voltage and the compensation voltage; transmitting, by the first control sub-circuit, the second voltage on the data voltage terminal to the first node under the control of a voltage on the first scanning signal terminal; transmitting, by the second control sub-circuit, the second voltage on the first node to the control terminal of the driving sub-circuit under the control of a voltage on the second scanning signal terminal; and outputting, by the driving sub-circuit, the driving current under the control of a voltage on the control terminal of the driving sub-circuit; and in a third period, maintaining, by the energy storage sub-circuit, the voltage on the first node as the second voltage, and transmitting, by the second control sub-circuit, the second voltage at the first node to the control terminal of the driving sub-circuit under the control of a voltage on the second scanning signal terminal; and outputting, by the driving sub-circuit, the driving current under the control of a voltage on the control terminal of the driving sub-circuit.

Optionally, the pixel circuit further includes a display sub-circuit, in the second period and the third period, the method further includes: displaying, by the display sub-circuit, a gray scale under driving of the driving current.

In a third aspect, a display panel is provided. The display panel includes the pixel circuit according to the first aspect described above.

In a fourth aspect, a display device is provided. The display device includes the pixel circuit according to the first aspect described above.

BRIEF DESCRIPTION OF THE DRAWINGS

In order to describe technical solutions in embodiments of the present disclosure more clearly, the accompanying drawings to be used in the description of embodiments will be introduced briefly. Obviously, the accompanying drawings to be described below are merely some embodiments of the present disclosure, and a person of ordinary skill in the art can obtain other drawings according to these drawings without paying any creative effort.

DETAILED DESCRIPTION

The technical solutions in embodiments of the present disclosure will be described clearly and completely with reference to the accompanying drawings in embodiments of the present disclosure. Obviously, the described embodiments are merely some but not all of embodiments of the present disclosure. All other embodiments made on the basis of the embodiments of the present disclosure by a person of ordinary skill in the art without paying any creative effort shall be included in the protection scope of the present disclosure.

Transistors used in all embodiments of the present disclosure may be thin film transistors or field-effect transistors or other devices having same properties. The transistors used in the embodiments of the present disclosure are mainly switching transistors depending on functions thereof in the circuit. Since a source and a drain of a switching transistor used herein are symmetrical, the source and the drain are interchangeable. In the embodiments of the present disclosure, in order to distinguish two electrodes of a transistor other than a gate, the source is referred to as a first electrode, and the drain is referred to as a second electrode. According to forms in the accompanying drawings, a middle terminal of the transistor is defined as a gate, a signal input terminal of the transistor is defined as a source, and a signal output terminal of the transistor is defined as a drain. In addition, the switching transistors used in the embodiments of the present disclosure include P-type switching transistors and N-type switching transistors. A P-type switching transistor is turned on when a gate is at a low level, and is in off state when the gate is at a high level. An N-type switching transistor is turned on when a gate is at a high level, and is in the off state when the gate is at a low level. Driving transistors include P-type driving transistors and N-type driving transistors. A P-type driving transistor is in an amplified state or a saturation state when the potential at the gate is at a low level (the potential at the gate is less than a potential at a source) and an absolute value of a gate-to-source voltage is greater than a threshold voltage. An N-type driving transistor is in an amplified state or a saturation state when a potential at the gate is at a high level (the potential at the gate is greater than a potential at a source) and an absolute value of a gate-to-source voltage is greater than a threshold voltage.

It will be noted that, words "first", "second", etc. in the present disclosure are merely used to distinguish same or similar items whose functions and effects are substantially the same. The words "first", "second", etc. are not intended to limit a quantity or an order of execution.

Figure 1:
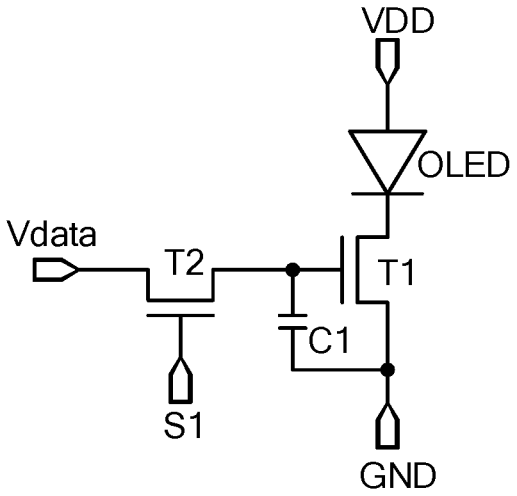
FIG. 1 is a circuit diagram of an exemplary pixel circuit.

Referring to FIG. 1, in one example, a driving circuit diagram of a sub-pixel in an OLED display includes a driving transistor T1, a switching transistor T2, a capacitor C1 and an OLED device. A current flowing through the driving transistor T1 may be indicated by the following formula: $I=k(V_{gs}-V_{th})^2$, wherein $V_{th}$ is a threshold voltage of the driving transistor T1, $V_{gs}$ is a voltage across two electrodes of the capacitor C1, and k is a mobility of the driving transistor T1. However, due to limitations of a crystallization process, there are certain differences in threshold voltages and mobilities of different driving transistors (full name in English: Thin Film Transistor, and abbreviated as TFT). The differences will be transformed into differences in current and luminance of the OLED display device, which will be perceived by human eyes. The threshold voltage and the mobility of the driving transistor will drift during a long-term use of the OLED display, and the drifts of the driving transistors on different parts of the OLED display are different, thereby further causing a difference in display luminance, and greatly affecting a luminance uniformity of the OLED display and a service life of the OLED display.

Figure 2A:
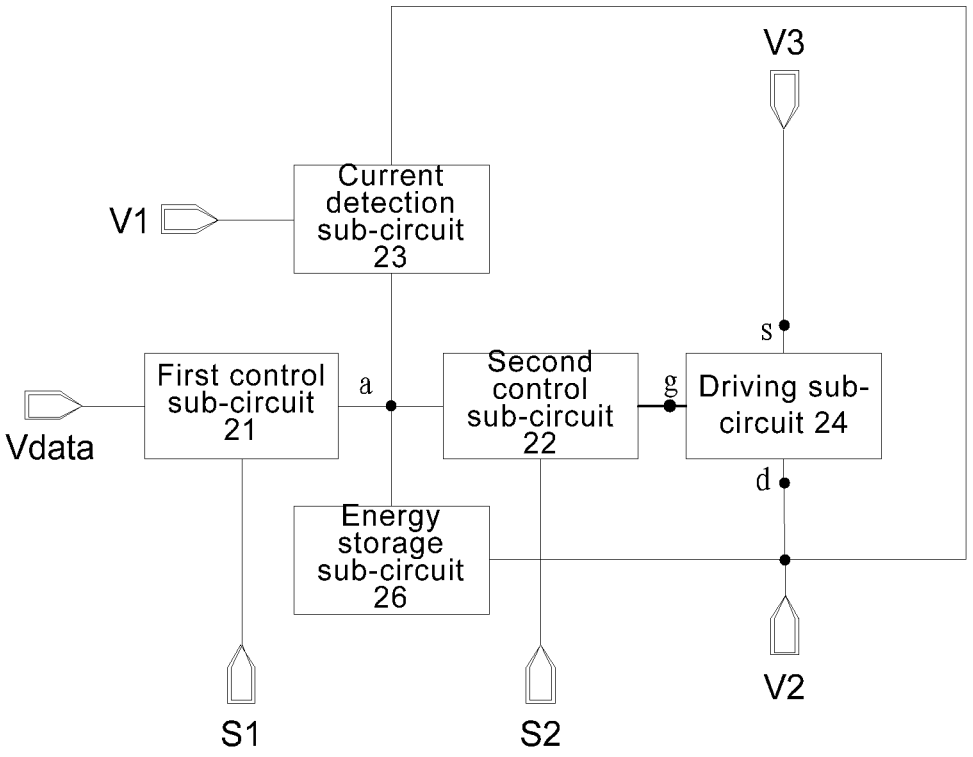
FIG. 2*a* is a schematic structural diagram of a pixel circuit in accordance with embodiments of the present disclosure.

In addition to the example described above, embodiments of the present disclosure further provide a pixel circuit. Referring to FIG. 2*a*, the pixel circuit includes a first control sub-circuit 21, a second control sub-circuit 22, a current detection sub-circuit 23, a driving sub-circuit 24 and an energy storage sub-circuit 26.

The first control sub-circuit 21 is coupled to a data voltage terminal Vdata, a first scanning signal terminal S1 and a first node a, and the first control sub-circuit 21 is configured to transmit a voltage on the data voltage terminal Vdata to the first node a under control of a voltage on the first scanning signal terminal S1.

The second control sub-circuit 22 is coupled to a control terminal g of the driving sub-circuit 24, a second scanning signal terminal S2 and the first node a, and the second control sub-circuit 22 is configured to transmit a voltage on the first node a to the control terminal g of the driving sub-circuit 24 under control of a voltage on the second scanning signal terminal S2.

The current detection sub-circuit 23 is coupled to a first level terminal V1, a second level terminal V2 and the first node a, and the current detection sub-circuit 23 is configured to output a detection current under control of a voltage on the first node a and detect a current value of the detection current.

An input terminal s of the driving sub-circuit 24 is coupled to a third level terminal V3, an output terminal d of the driving sub-circuit 24 is coupled to the second level terminal V2, and the driving sub-circuit 24 is configured to output a driving current under control of a voltage on the control terminal g of the driving sub-circuit 24.

The energy storage sub-circuit 26 is coupled to the first node a and the second level terminal V2, and the energy storage sub-circuit 26 is configured to store electric energy.

The pixel circuit provided by the embodiments of the present disclosure includes the first control sub-circuit, the second control sub-circuit, the current detection sub-circuit, the driving sub-circuit and the energy storage sub-circuit. A voltage on the data voltage terminal may be transmitted via the first control sub-circuit to the first node under control of a voltage on the first scanning signal terminal. The voltage on the first node may be transmitted via the second control sub-circuit to the control terminal of the driving sub-circuit under control of a voltage on the second scanning signal terminal. A detection current may be output from the current detection sub-circuit under control of a voltage on the first node and a current value of the detection current may be detected by the current detection sub-circuit. A driving current may be output from the driving sub-circuit under control of a voltage on the control terminal of the driving sub-circuit. The energy storage sub-circuit may store electrical energy. Therefore, in the pixel circuit provided in the above embodiments, an input voltage on the data voltage terminal may be adjusted such that a current value of the detection current output from the current detection sub-circuit is equal to a current value of the detection current output from the current detection sub-circuit in an initial state, and then a compensation voltage value is obtained according to the present voltage value of the data voltage terminal and an initial voltage value of the data voltage terminal. Next, during a display driving, the compensation voltage is added into a data voltage and they are input via the data voltage terminal, thereby compensating the driving circuit. Since the compensation method described above may be used for directly compensating a current output from the driving sub-circuit, the driving transistor may be compensated depending on all performance changes, thereby enhancing a display uniformity of the OLED display and increasing a service life of the OLED display.

Figure 2B:
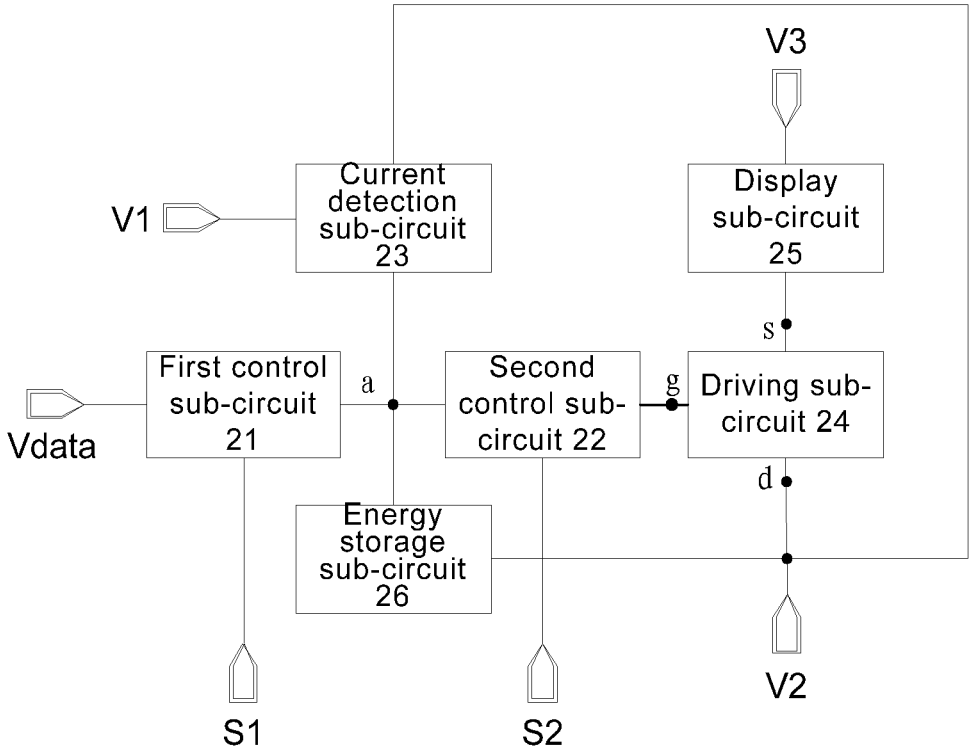
FIG. 2*b* is a schematic structural diagram of an improved pixel circuit based on the pixel circuit shown in FIG. 2*a;*

As an improved example, as shown in FIG. 2*b*, a display sub-circuit 25 may be included into the pixel circuit. An input terminal of the display sub-circuit 25 is coupled to the third level terminal V3, and an output terminal of the display sub-circuit 25 is coupled to the input terminal s of the driving sub-circuit 24. The display sub-circuit 25 is configured to display a gray scale under driving of the driving current. When a display is performed by using the pixel circuit described above, the display sub-circuit 25 may perform the display by using a compensated current.

Figure 3:
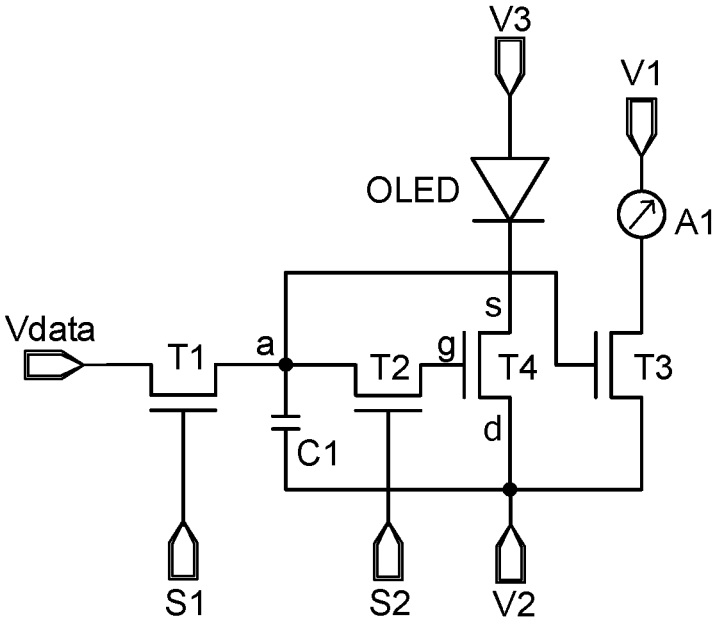
FIG. 3 is a circuit diagram of a pixel circuit in accordance with embodiments of the present disclosure.

Referring to FIG. 3, the first control sub-circuit 21 includes a first transistor T1.

A first electrode of the first transistor T1 is coupled to the data voltage terminal Vdata, a second electrode of the first transistor T1 is coupled to the first node a, and a gate of the first transistor T1 is coupled to the first scanning signal terminal S1.

The second control sub-circuit 22 includes a second transistor T2.

A first electrode of the second transistor T2 is coupled to the first node a, a second electrode of the second transistor T2 is coupled to the control terminal g of the driving sub-circuit 24, and a gate of the second transistor T2 is coupled to the second scanning signal terminal S2.

The current detection sub-circuit 23 includes a current detection device A1 and a third transistor T3.

An input terminal of the current detection device A1 is coupled to the first level terminal V1, and an output terminal of the current detection device A1 is coupled to a first electrode of the third transistor T3. A second electrode of the third transistor T3 is coupled to the second level terminal V2, and a gate of the third transistor T3 is coupled to the first node a.

For example, the above current detection device may be an ammeter.

The driving sub-circuit 24 is a driving transistor T4, the input terminal s of the driving sub-circuit 24 is a source of the driving transistor T4, the control terminal g of the driving sub-circuit 24 is a gate of the driving transistor T4, and the output terminal d of the driving sub-circuit 24 is a drain of the driving transistor T4.

When the display sub-circuit is included into the pixel circuit, the display sub-circuit 25 may include an organic light-emitting diode (OLED).

An anode of the OLED is coupled to the third level terminal V3, and a cathode of the OLED is coupled to the input terminal s of the driving sub-circuit 24.

The energy storage sub-circuit 26 includes a first capacitor C1.

A first electrode of the first capacitor C1 is coupled to the first node a, and a second electrode of the first capacitor C1 is coupled to the second level terminal V2.

Optionally, the first transistor T1 and the second transistor T2 are both N-type transistors. Alternatively, the first transistor T1 and the second transistor T2 are both P-type transistors.

Figure 4:
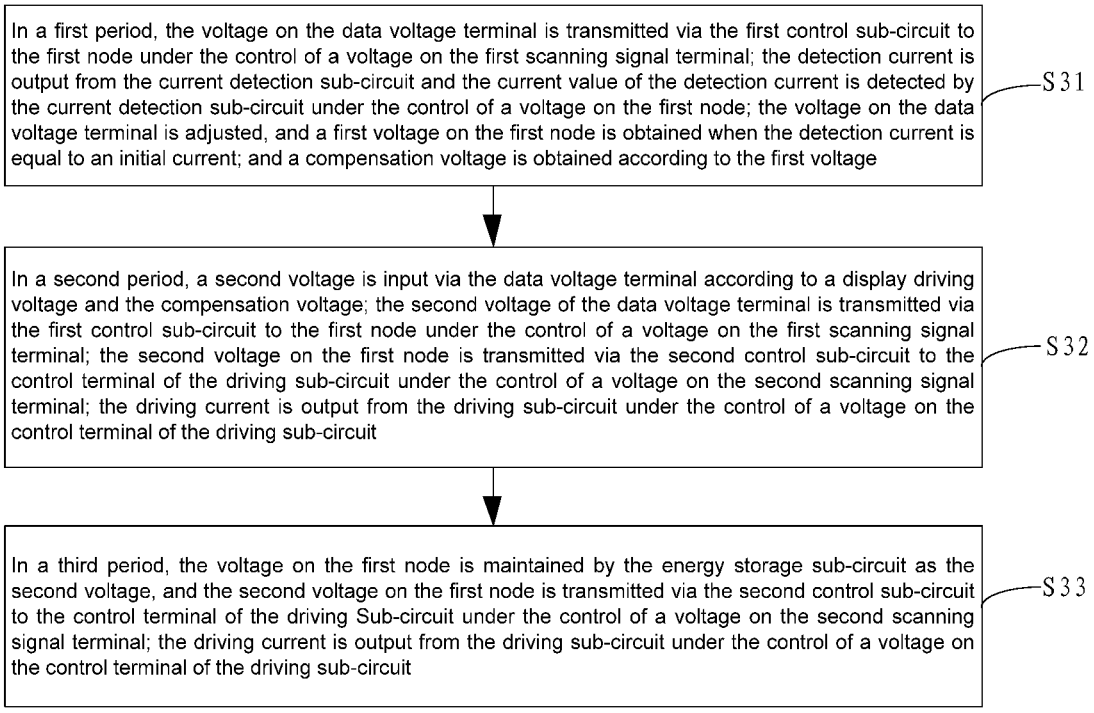
FIG.4 is a flow chart of steps of a method of driving a pixel circuit in accordance with the embodiments of the present disclosure.

Embodiments of the present disclosure provide a method of driving a pixel circuit, and the method is used for driving the pixel circuit provided by any embodiment of the embodiments described above. Referring to FIG. 4, the method includes the following steps.

In S31, in a first period, the first control sub-circuit transmits a voltage on the data voltage terminal to the first node under the control of a voltage on the first scanning signal terminal; the current detection sub-circuit outputs the detection current under the control of the voltage on the first node and detects the current value of the detection current; the voltage on the data voltage terminal is adjusted, and a first voltage on the first node is obtained when the detection current is equal to an initial current; and a compensation voltage is obtained based on the first voltage.

The compensation voltage is a voltage difference between the first voltage and an initial voltage. A current value of the initial current is a current value of the detection current in an initial state and when the voltage on the first node is the initial voltage.

It will be noted that, the initial state in the embodiments described above refers to a state before performances of the transistors in the pixel circuit drift. For example, a state before the pixel circuit is put into use. In addition, a relationship between the initial voltage and the initial current is that in the initial state, a voltage is applied to the first node (a voltage is applied to the data voltage terminal through a peripheral circuit, and then the voltage is transmitted to the first node), and a current value detected by the current detection sub-circuit at this time is recorded. The voltage applied to the first node and the current value detected by the current detection sub-circuit are the initial voltage and the initial current, respectively. For example, in the initial state, if a voltage of 5V is applied to the first node and the current value detected by the current detection sub-circuit is 0.1A, the initial voltage is 5 V and the initial current is 0.1 A. In addition, it will be known from the definitions and the processes of obtaining the initial voltage and the initial current described above that, when the initial voltage changes, the initial current will also change with the initial voltage. Therefore, in actual use, it is only necessary to apply any voltage to the first node and then record the current value detected by the current detection sub-circuit at this time.

It will also be noted that when the voltage on the data voltage terminal Vdata is adjusted, the voltage on the data voltage terminal Vdata may be gradually adjusted from large to small, and a corresponding current value of the detection current gradually changes from large to small. In addition, the voltage on the data voltage terminal Vdata may also be gradually adjusted from small to large, and the corresponding current value of the detection current gradually changes from small to large. It will be seen from the foregoing description that after the pixel circuit is used for a period of time, a threshold voltage and a mobility of the pixel circuit will drift. In this case, it is difficult to obtain an expected initial current in the pixel circuit even though the initial voltage is applied to the data voltage terminal Vdata, which requires adjusting the voltage on the data voltage terminal Vdata, thereby adjusting a current flowing through the display sub-circuit in the pixel circuit, so that the current reaches the initial current. For example, an initial value of the voltage on the data voltage terminal Vdata may be defined as the initial voltage, and then the voltage on the data voltage terminal Vdata is gradually increased from the initial voltage until the detection current is equal to the initial current.

In S32, in a second period, a second voltage is input via the data voltage terminal according to a display driving voltage and the compensation voltage; the first control sub-circuit transmits the second voltage on the data voltage terminal to the first node under the control of a voltage on the first scanning signal terminal; the second control sub-circuit transmits the second voltage on the first node to the control terminal of the driving sub-circuit under the control of a voltage on the second scanning signal terminal; the driving sub-circuit outputs a driving current under the control of the voltage on the control terminal of the driving sub-circuit; and when the display sub-circuit is included into the pixel circuit, the display sub-circuit displays a gray scale under the driving of the driving current.

The second voltage is a sum of the display driving voltage and the compensation voltage.

The display driving voltage in the embodiments described above refers to a value of a voltage to be applied to the control terminal of the driving sub-circuit in a display signal for driving a display panel to display an image.

In S33, in a third period, the energy storage sub-circuit maintains the voltage on the first node as the second voltage, and the second control sub-circuit transmits the second voltage on the first node to the control terminal of the driving sub-circuit under the control of a voltage on the second scanning signal terminal; the driving sub-circuit outputs the driving current under the control of the voltage on the control terminal of the driving sub-circuit; and when the display sub-circuit is included into the pixel circuit, the display sub-circuit displays the gray scale under the driving of the driving current.

In the method of driving the pixel circuit provided by the embodiments of the present disclosure, in the first period, the voltage on the data voltage terminal is transmitted via the first control sub-circuit to the first node, the detection current is output from the current detection sub-circuit under the control of the voltage on the first node and the current value of the detection current is detected by the current detection sub-circuit, the first voltage on the first node is obtained when the detection current is equal to the initial current, and the compensation voltage is obtained according to the first voltage. In the second period, the second voltage (the second voltage is the sum of the display driving voltage and the compensation voltage) on the data voltage terminal is transmitted via the first control sub-circuit to the first node under the control of a voltage on the first scanning signal terminal, and then the second voltage on the first node is transmitted via the second control sub-circuit to the control terminal of the driving sub-circuit, so that the driving current is output from the driving sub-circuit, and when the display sub-circuit is included, the display sub-circuit displays the gray scale under the driving of the driving current. In the third period, the voltage on the first node may be maintained by the energy storage sub-circuit as the second voltage, so that the driving current output from the driving sub-circuit may be maintained unchanged, and when the display sub-circuit is included, the display sub-circuit may always display the gray scale under the driving of the driving current. Therefore, the input voltage on the data voltage terminal may be adjusted to make the current value of the detection current output from the current detection sub-circuit equal to the current value of the detection current output from the current detection sub-circuit in the initial state, and then the compensation voltage value is obtained according to the present voltage value of the data voltage terminal and the initial voltage value. Next, during the display driving, the compensation voltage is added into the data voltage and input via the data voltage terminal, thereby compensating the driving circuit. Since the compensation method described above may be used for directly compensating the current output from the driving sub-circuit, the driving transistor may be compensated depending on all performance changes, thereby enhancing the display uniformity of the OLED display and increasing the service life of the OLED display.

A working principle of the method of driving the pixel circuit shown in FIG. 3 and the pixel circuit shown in FIG. 4 will be described below with reference to the schematic diagram showing a timing state in FIG. 5 by taking an example in which the first level terminal V1 is at a high level, the second level terminal V2 is at a low level, the third level terminal V3 is at a high level, and the transistors in the pixel circuit shown in FIG. 3 are all N-type transistors. For example, the second level terminal V2 may be grounded.

Figure 5:
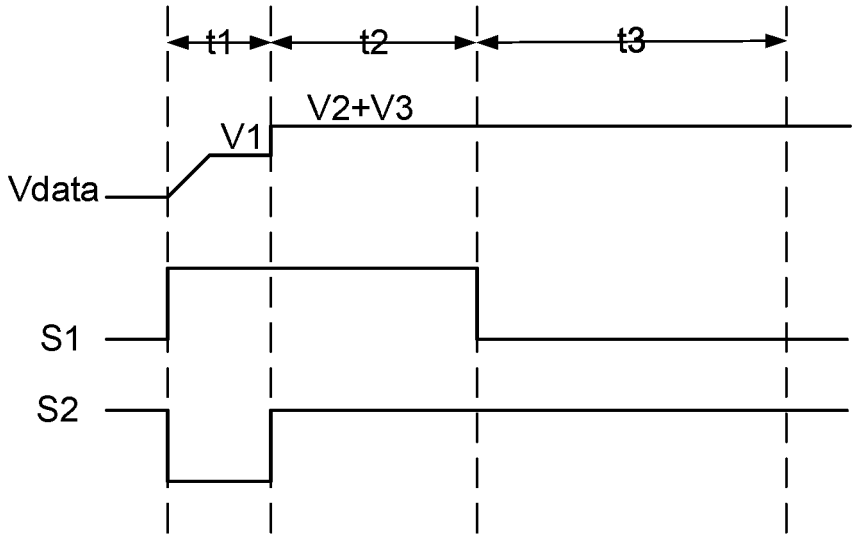
FIG. 5 is a diagram showing a timing of each signal in the pixel circuit provided by the embodiments of the present disclosure.

FIG. 5 is a diagram showing timings of the voltage on the data voltage terminal Vdata, a first scanning signal from the first scanning signal terminal S1 and a second scanning signal from the second scanning signal terminal S2. As shown in FIG. 5, timing states of three periods are provided. A first period is t1, a second period is t2, and a third period is t3.

In the period t1, a high level is input via the first scanning signal terminal S1, the first transistor T1 is turned on, and the voltage on the data voltage terminal Vdata may be transmitted to the first node a through the first transistor T1, and then transmitted to the gate of the third transistor T3. In this way, the voltage may be applied to the gate of the third transistor T3, and thus there is a current flowing through the current detection device A1 and the third transistor T3, and the ammeter A1 may detect the current value of the detection current. The voltage on the first node a may be adjusted by adjusting the voltage on the data voltage terminal Vdata, thereby adjusting a potential at the gate of the third transistor T3, and changing current flowing through the current detection device A1 and the third transistor T3. When the detection current detected by the ammeter A1 is equal to the initial current, the voltage value (i.e. the voltage on the first node) input via the data voltage terminal Vdata is recorded as the first voltage V1 (exemplarily, as shown in FIG. 5, in the period t1, the voltage on the data voltage terminal Vdata may be adjusted from small to large until the detection current detected by the ammeter A1 is equal to the initial current, that is, the adjustment of the voltage on the data voltage terminal Vdata is stopped when the voltage on the data voltage terminal Vdata is V1). Then the compensation voltage V2 is obtained according to the first voltage V1 and the initial voltage V0 (V2 is a difference between V1 and V0). In addition, since a low level is input via the second scanning signal terminal S2, the second transistor T2 is in the off state, and the voltage cannot be transmitted to the gate of the driving transistor T4. Therefore, when the organic light-emitting diode (OLED) is included into the pixel circuit, no current flows through the OLED, and the pixel circuit does not display the gray scale.

In the period t2, a second voltage (the sum of a display driving voltage V3 and the compensation voltage V2) is input via the data voltage terminal Vdata, and a high level is input via the first scanning signal terminal S1 and the second scanning signal terminal S2. Therefore, the second voltage on the data voltage terminal is transmitted to the gate of the driving transistor T4 through the first transistor T1 and the second transistor T2. Moreover, since the driving transistor T4 and the third transistor T3 are in a same working condition (i.e., the driving transistor T4 and the third transistor T3 are in a same working state), a current change of the driving transistor T4 is the same as a current change of the third transistor T3. In addition, since the voltage applied to the gate of the driving transistor T4 is the sum of the display driving voltage and the compensation voltage, after the compensation voltage is added into the display driving voltage to be applied to the gate of the driving transistor T4, the value of the current output from the driving transistor T4 may be compensated, so that a stable driving current is output from the driving transistor. The OLED displays the gray scale under the driving of the driving current, thereby enhancing the display uniformity of the OLED display and increasing the service life of the OLED display.

In the period t3, a low level is input via the first scanning signal terminal S1 and a high level is input via the second scanning signal terminal S2. The first transistor T1 is in the off state, and the second transistor T2 is in the on state. Since the first capacitor C1 is charged in the second period t2, and the voltage is the second voltage, and there is no discharging path in the period t3, the first capacitor C1 may always maintain the voltage on the first node a as the second voltage, so that the driving current output from the driving transistor T4 does not change, and the OLED always displays a stable gray scale under the driving of the driving current.

Further, the transistors in the embodiments described above may further be P-type transistors. If all the transistors are P-type transistors, it only necessary to re-adjust the timing state of each input signal in the pixel circuit. For example, the first level terminal V1 is adjusted to provide a low level, the first scanning signal terminal S1 in the period t1 of FIG. 5 is adjusted in a way that a low level is input via the first scanning signal terminal S1, the second scanning signal terminal S2 in the period t1 is adjusted in a way that a high level is input via the second scanning signal terminal S2, and other signals are also adjusted to be timing signals with opposite phases.

Further, the N-type transistors and the P-type transistors may also be simultaneously used in the pixel circuit described above. In this case, it is necessary to ensure that the type of the transistors controlled by a same timing signal or voltage in the pixel circuit is the same, which is of course a reasonable workaround that may be made by a person skilled in the art in accordance with the embodiments of the present disclosure, and thus shall be included in the protection scope of the present disclosure. However, considering manufacturing processes of transistors, since doped materials of active layers of different types of transistors are different, a use of a same type of the transistors in the pixel circuit is more advantageous for the manufacturing process of the pixel circuit.

Some embodiments of the present disclosure provide a display panel, and the display panel includes the pixel circuit according to any embodiment of the embodiments described above. The display panel may be an OLED display panel.

Some embodiments of the present disclosure provide a display device, and the display device includes the pixel circuit according to any embodiment of the embodiments described above.

Exemplarily, the display device may be an electronic paper, a mobile phone, a tablet computer, a television, a display, a notebook computer, a digital photo frame, a navigator, or any other product or component having a display function.

The foregoing descriptions are merely some specific implementation manners of the present disclosure, but the protection scope of the present disclosure is not limited thereto. Any person skilled in the art could readily conceive of changes or replacements within the technical scope of the present disclosure, which shall all be included in the protection scope of the present disclosure. Therefore, the protection scope of the present disclosure shall be subject to the protection scope of the claims.

What is claimed is:

1. A pixel circuit, comprising: a first control sub-circuit, a second control sub-circuit, a current detection sub-circuit, a driving sub-circuit and an energy storage sub-circuit, wherein the first control sub-circuit is coupled to a data voltage terminal, a first scanning signal terminal and a first node, and the first control sub-circuit is configured to transmit a voltage on the data voltage terminal to the first node under control of a voltage on the first scanning signal terminal;

the second control sub-circuit is coupled to a control terminal of the driving sub-circuit, a second scanning signal terminal and the first node, and the second control sub-circuit is configured to transmit a voltage on the first node to the control terminal of the driving sub-circuit under control of a voltage on the second scanning signal terminal;

the current detection sub-circuit is coupled to a first level terminal, a second level terminal and the first node, and the current detection sub-circuit is configured to output a detection current under control of a voltage on the first node and detect a current value of the detection current;

an input terminal of the driving sub-circuit is coupled to a third level terminal, an output terminal of the driving sub-circuit is coupled to the second level terminal, and the driving sub-circuit is configured to output a driving current under control of a voltage on the control terminal of the driving sub-circuit; and the energy storage sub-circuit is coupled to the first node and the second level terminal, and the energy storage sub-circuit is configured to store electric energy.

2. The pixel circuit according to claim 1, wherein the pixel circuit further comprises a display sub-circuit; and an input terminal of the display sub-circuit is coupled to the third level terminal, an output terminal of the display sub-circuit is coupled to the input terminal of the driving sub-circuit, and the display sub-circuit is configured to display a gray scale under driving of the driving current.

3. The pixel circuit according to claim 2, wherein the display sub-circuit includes an organic light-emitting diode; and an anode of the organic light-emitting diode is coupled to the third level terminal, and a cathode of the organic light-emitting diode is coupled to the input terminal of the driving sub-circuit.

4. The pixel circuit according to claim 2, wherein the first control sub-circuit includes a first transistor, the second control sub-circuit includes a second transistor, the driving sub-circuit is a driving transistor, the display sub-circuit includes an organic light-emitting diode, the current detection sub-circuit includes a current detection device and a third transistor, and the energy storage sub-circuit includes a first capacitor, and wherein a first electrode of the first transistor is coupled to the data voltage terminal, a second electrode of the first transistor is coupled to the first node, and a gate of the first transistor is coupled to the first scanning signal terminal;

a first electrode of the second transistor is coupled to the first node, a gate of the second transistor is coupled to the second scanning signal terminal, a second electrode of the second transistor is coupled to a gate of the driving transistor, a drain of the driving transistor is coupled to the second level terminal, a source of the driving transistor is coupled to a cathode of the organic light-emitting diode, and an anode of the organic light-emitting diode is coupled to the third level terminal;

a gate of the third transistor is coupled to the first node, a first electrode of the third transistor is coupled to an output terminal of the current detection device, a second electrode of the third transistor is coupled to the second level terminal, an input terminal of the current detection device is coupled to the first level terminal; and a first electrode of the first capacitor is coupled to the first node, and a second electrode of the first capacitor is coupled to the second level terminal.

5. The pixel circuit according to claim 1, wherein the first control sub-circuit includes a first transistor;

a first electrode of the first transistor is coupled to the data voltage terminal, a second electrode of the first transistor is coupled to the first node, and a gate of the first transistor is coupled to the first scanning signal terminal.

6. The pixel circuit according to claim 5, wherein the second control sub-circuit includes a second transistor;

a first electrode of the second transistor is coupled to the first node, a second electrode of the second transistor is coupled to the control terminal of the driving sub-circuit, and a gate of the second transistor is coupled to the second scanning signal terminal.

7. The pixel circuit according to claim 6, wherein the first transistor and the second transistor are both N-type transistors; or the first transistor and the second transistor are both P-type transistors.

8. The pixel circuit according to claim 1, wherein the current detection sub-circuit includes a current detection device and a third transistor;

an input terminal of the current detection device is coupled to the first level terminal, and an output terminal of the current detection device is coupled to a first electrode of the third transistor; and a second electrode of the third transistor is coupled to the second level terminal, and a gate of the third transistor is coupled to the first node.

9. The pixel circuit according to claim 1, wherein the driving sub-circuit is a driving transistor, the input terminal of the driving sub-circuit is a source of the driving transistor, the control terminal of the driving sub-circuit is a gate of the driving transistor, and the output terminal of the driving sub-circuit is a drain of the driving transistor.

10. The pixel circuit according to claim 1, wherein the energy storage sub-circuit includes a first capacitor;

a first electrode of the first capacitor is coupled to the first node, and a second electrode of the first capacitor is coupled to the second level terminal.

11. A method of driving the pixel circuit according to claim 1, the method comprising:

in a first period, transmitting, by the first control sub-circuit, the voltage on the data voltage terminal to the first node under the control of a voltage on the first scanning signal terminal; outputting, by the current detection sub-circuit, the detection current and detecting, by the current detection sub-circuit, the current value of the detection current under the control of a voltage on the first node; adjusting the voltage on the data voltage terminal, and obtaining a first voltage on the first node in response to the detection current being equal to an initial current; obtaining a compensation voltage according to the first voltage, wherein the compensation voltage is a voltage difference between the first voltage and an initial voltage; and a current value of the initial current is a current value of the detection current in an initial state and when the voltage on the first node is the initial voltage;

in a second period, inputting, via the data voltage terminal, a second voltage according to a display driving voltage and the compensation voltage; the second voltage being a sum of the display driving voltage and the compensation voltage; transmitting, by the first control sub-circuit, the second voltage on the data voltage terminal to the first node under the control of a voltage on the first scanning signal terminal; transmitting, by the second control sub-circuit, the second voltage on the first node to the control terminal of the driving sub-circuit under the control of a voltage on the second scanning signal terminal; and outputting, by the driving sub-circuit, the driving current under the control of a voltage on the control terminal of the driving sub-circuit; and in a third period, maintaining, by the energy storage sub-circuit, the voltage on the first node as the second voltage, and transmitting, by the second control sub-circuit, the second voltage on the first node to the control terminal of the driving sub-circuit under the control of a voltage on the second scanning signal terminal; and outputting, by the driving sub-circuit, the driving current under the control of a voltage on the control terminal of the driving sub-circuit.

12. The method of driving the pixel circuit according to claim 11, wherein the pixel circuit further includes a display sub-circuit, in the second period and the third period, the method further includes:

displaying, by the display sub-circuit, a gray scale under driving of the driving current.

13. A display panel, comprising the pixel circuit according to claim 1.

14. A display device, comprising the pixel circuit according to claim 1.

* * * * *